United States Patent [19]

Costa

[11] Patent Number: 4,969,070

[45] Date of Patent: Nov. 6, 1990

[54] FLUORESCENT FIXTURE HOUSING

[75] Inventor: Larry J. Costa, Danville, Ill.

[73] Assignee: Valmont Industries, Inc., Valley, Nebr.

[21] Appl. No.: 380,306

[22] Filed: Jul. 17, 1989

[51] Int. Cl.[5] ..... F21V 23/02; F21S 3/00

[52] U.S. Cl. ..... 362/221; 362/217; 362/260

[58] Field of Search ..... 362/217, 221, 260

[56] References Cited

U.S. PATENT DOCUMENTS

| | | | |
|---|---|---|---|
| 3,040,170 | 6/1962 | Chwan | 362/221 |
| 3,135,822 | 6/1964 | Baran et al. | 362/260 X |
| 3,514,590 | 5/1970 | Schaeffer | 362/221 X |
| 4,025,780 | 5/1977 | Krase et al. | 362/221 |
| 4,504,891 | 3/1985 | Mazis | 362/260 X |
| 4,674,015 | 6/1987 | Smith | 362/217 |
| 4,799,134 | 1/1989 | Pinch et al. | 362/221 X |

*Primary Examiner*—Allen M. Ostrager
*Attorney, Agent, or Firm*—Zarley, McKee, Thomte, Voorhees & Sease

[57] ABSTRACT

A fluorescent fixture housing is preferably molded of a thermoplastic material, and includes a base portion, a pair of longitudinal sides and a pair of opposite ends. A pair of lamp holders are mounted to the housing on opposite ends so as to receive and hold a lamp therebetween. A pair of electrical connectors are mounted to the housing and lamp holders, and are electrically connected to the lamp holders to supply power to a lamp mounted between the lamp holders. Electrical conductors are mounted to the fixture housing and are connected between the lamp holders and a wiring harness, the wiring harness being removably connected to a ballast. The wiring harness is mounted to the base of the fixture and the ballast is slidably interconnected with the wiring harness to affix it in position. In a second embodiment, the wiring harness remains free from the fixture, and the ballast is removably mounted in the desired location on th base portion of the fixture. In a third embodiment, the wiring harness is molded integrally with a lamp holder and electrical connector at one end of the housing, so as to eliminate any discrete conductors therebetween.

3 Claims, 3 Drawing Sheets

FLUORESCENT FIXTURE HOUSING

TECHNICAL FIELD

The present invention relates generally to fluorescent lamp fixtures, and more particularly to an improved lamp fixture with electrical conductors mounted thereon between the lampholders and the ballast.

BACKGROUND OF THE INVENTION

Present fluorescent fixtures utilize ballasts which are positioned within a ballast case comprised of a flat base portion and a cover portion secured thereto. The conventional ballasts normally include a core and coil subassembly mounted on one end of the base portion with the terminations of the coils extending therefrom. The core and coil assembly is preferably positioned in the case so that the assembly is spaced from the top surface of the case and the sides thereof for heat and sound insulation purposes. During the manufacture of the ballast, elongated flexible external leads are electrically connected to predetermined coil terminations. The total subassembly may then be encased in an asphalt silica sand potting compound. The base portion is then positioned over the ballast components and secured to the case portion with the flexible leads extending outwardly from the case. These discrete external leads are subsequently electrically connected to leads or terminals in the appropriate lamp holders.

While the above described fixtures are generally satisfactory in operation, they do suffer several drawbacks or disadvantages. One disadvantage of prior art fixtures is that different lamp manufacturers require ballasts having leads of different lengths, thereby requiring the ballast manufacturer to produce, and inventory, ballasts having various lead lengths. Further, each individual manufacturer may require various length leads to accommodate various lamp fixtures.

A further disadvantage of the prior art ballasts and fluorescent fixtures is that the external leads, which extend from the ballast, often interfere with other assembly operations. Because the location of the lamp holders and ballast varies in different fixtures, it is necessary to connect all of the discrete leads after the lamp holders have been installed on the fixture. The installation of lamp holders and ballast, and the subsequent connection of the discrete leads to the various components, is inefficient and time consuming for the manufacturer.

One form of a ballast which overcomes several of the problems associated with ballasts having discrete leads, is disclosed in U.S. patent application Ser. No. 257,538, filed Oct. 14, 1988, entitled "An Improved Ballast", the disclosure of which is incorporated herein by reference. The ballast of the co-pending application may be described as a "lead-less ballast" in view of the fact that no discrete conductors extend from the ballast. Rather, the core and coil subassembly is mounted in one end of a case, and has terminal pins extending from one end of the core and coil subassembly which are connected to an electrical connector means. The ballast case is provided with an access opening formed therein to facilitate the extension or insertion of one end of a wiring harness therethrough which is electrically connected to the electrical connector to complete the desired wiring circuit.

Another form of leadless ballast is disclosed in the co-pending application entitled "Improved End Connector for a Ballast", filed simultaneously herewith, the disclosure of which is incorporated herein by reference. While the improved ballast of co-pending application Ser. No. 257,538 created a lead-less ballast, the wiring harness was connected to the ballast through an opening in the top of the ballast case. The new "end-connector" ballast avoids the need for long conductors to a wiring harness because the harness is connected to the ballast adjacent the ballast case base, so that the wires do not project outwardly into the lamp fixture.

It is therefore a general object of the present invention to provide an improved fluorescent lamp fixture having electrical conductors mounted therein between the lamp holders and electrical connections to reduce discrete leads.

Another object of the present invention is to provide a fluorescent lamp fixture which greatly reduces the time and labor necessary to assemble the fixture.

A further object of the present invention is to provide a lamp fixture with integral lamp holders.

A further object of the present invention is to provide a fluorescent lamp fixture which is economical to manufacture.

Yet another object is to provide a fluorescent lamp fixture which allows for the automated assembly of the fixture and ballast.

These and other objects of the present invention will be apparent to those skilled in the art.

SUMMARY OF THE INVENTION

The fluorescent fixture housing of the present invention is preferably molded of a thermoplastic material, and includes a base portion, a pair of longitudinal sides and a pair of opposite ends. A pair of lamp holders are mounted to the housing on opposite ends so as to receive and hold a lamp therebetween. A pair of electrical connectors are mounted to the housing, and are electrically connected to the lamp holders to supply power to a lamp mounted between the lamp holders. Electrical conductors are mounted to the fixture housing and connected between the lamp holders and a wiring harness, the wiring harness being removably connected to a ballast. In a first embodiment of the invention, the wiring harness is mounted to the base of the fixture and the ballast is slidably interconnected with the wiring harness, and then affixed in position.

In the second embodiment of the invention, the wiring harness remains free from the fixture, but the ballast is removably mounted in the desired location on the base portion of the fixture.

In a third embodiment of the invention, the wiring harness is molded integrally with a lamp holder and electrical connector at one end of the housing, so as to eliminate any discrete conductors therebetween. A small channel may be formed in the housing to receive conductors between the wiring harness and the lamp holders, to eliminate the presence of conductors projecting into the fixture.

DESCRIPTION OF THE PREFERRED EMBODIMENTS

Figure 1:
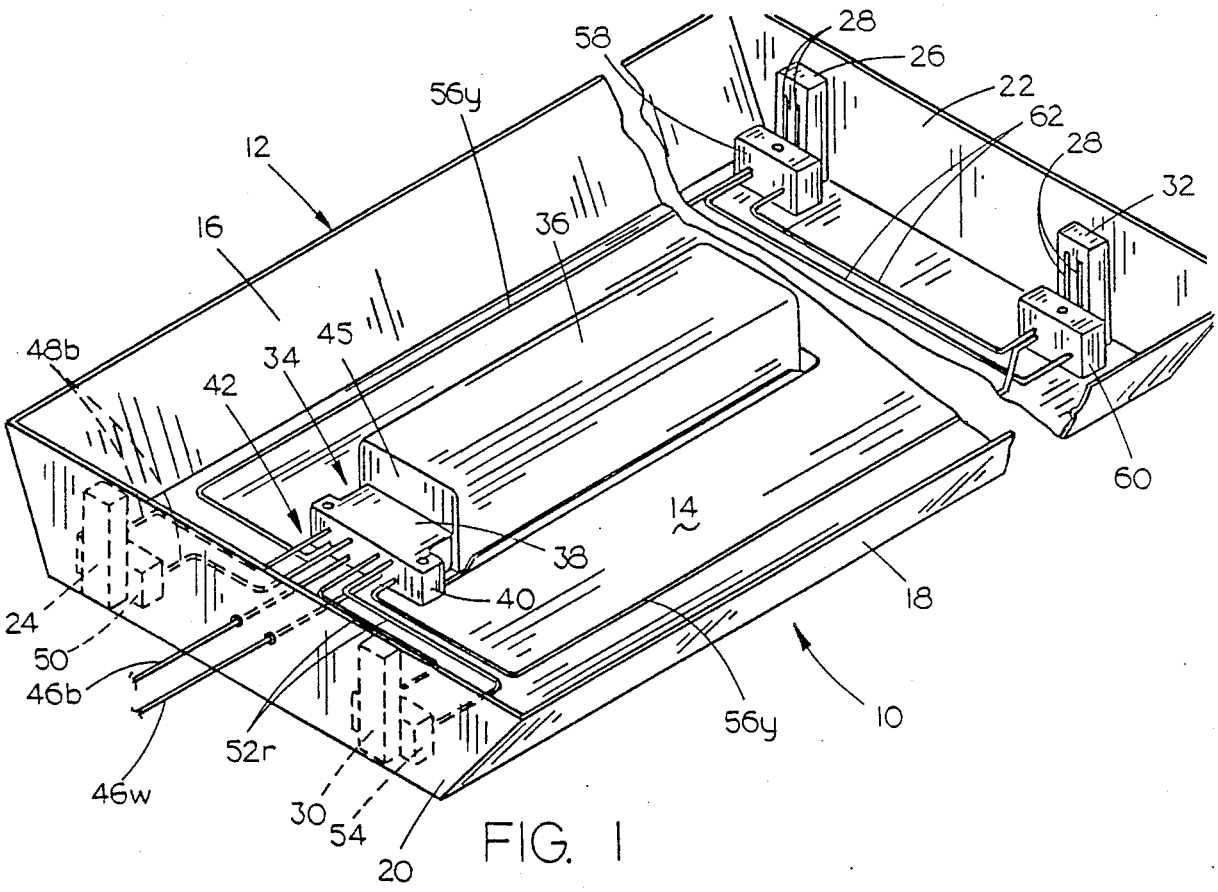
FIG. 1 is a perspective view of one embodiment of the invention with portions cut away for clarity.
Figure 2:
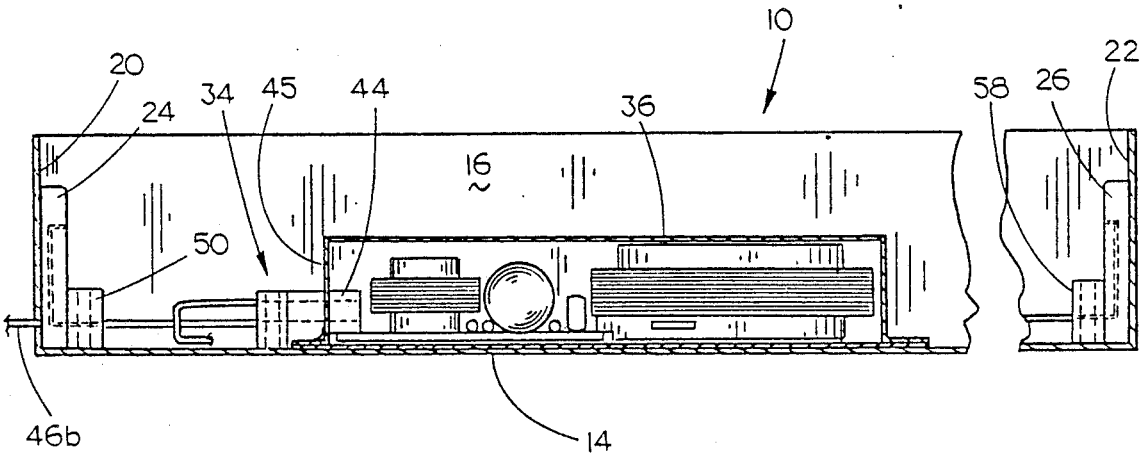
FIG. 2 is a longitudinal sectional view of the embodiment of FIG. 1.

Referring now to the drawings, in which identical or corresponding components are identified by the same reference numeral throughout the drawings, and more particularly to FIGS. 1 and 2, the fluorescent fixture of this invention is designated generally at 10 and includes a generally rectangular housing 12 having a flat base 14, a pair of upwardly projecting longitudinal opposite sides 16 and 18, and a pair of upwardly projecting opposite ends 20 and 22. A reflector (not shown) is mounted along the upper edge of sides and ends 16, 18, 20 and 22 so as to enclose fluorescent lamps (not shown) within housing 12, in a conventional fashion.

A first pair of lamp holders 24 and 26 are mounted to end walls 20 and 22 respectively, each having a pair of slots 28 directed inwardly into housing 12 which will receive the pins on the ends of a fluorescent light bulb (not shown) in a conventional fashion. A second pair of lamp holders 30 and 32 are mounted to housing 12 opposite lamp holders 24 and 26, on ends 20 and 22 respectively. In this manner, a pair of fluorescent lamps may be mounted within fixture 10 in the two pairs of lamp holders. Preferably, the lamp holders and housing are molded integrally, to reduce assembly time.

In the first embodiment of the invention, a wiring harness 34 is mounted to base 14, and is connected to a leadless ballast 36 as discussed in more detail hereinbelow. For purposes of the present description, wiring harness 34 will be described as having a forward end 38 and a rearward end 40. Rearward end 40 includes a series of electrical conductors, designated generally at 42, extending therefrom which will be connected to the various lamp holders 24, 26, 30 and 32, and to a power source (not shown). The forward end 38 of wiring harness 34 includes a series of terminals (not shown) which will connect with an end connector 44 mounted in the forward end 45 of ballast 36. The pin connections in forward end 38 of harness 34 are connected with the appropriate ballast connector pins, and thence to the appropriate electrical conductors 42. End connector 44 and the details of ballast 36 are described in the co-pending application entitled "Leadless Ballast with End Connector", filed simultaneously herewith, the disclosure of which is incorporated herein by reference.

As shown in FIGS. 1 and 2, wiring harness 34 is mounted to housing 12, and will assist in holding ballast 36 in place. One pair of conductors **46*b* and 46*w* extend from rearward end 40 of harness 34, and then outwardly through end 20 of housing 12. Conductors 46*b* and 46*w*** are connected to a power source to power the ballast and lamps.

A second pair of conductors **48*b* extend from rearward end 40 of harness 34 and thence to an electrical connector 50 which is electrically connected to lamp holder 24. Each conductor of conductor pair 48*b* are connected to one of slots 28 (not shown) in lamp holder 24, so as to electrically connect the pins of a lamp to ballast 36**.

A third pair of conductors **52*r* extend from rearward end 40 of harness 34 and thence to an electrical connector 54 electrically connected to lamp holder 30. Each conductor of conductor pair 52*r* is connected to one of slots 28 of lamp holder 30**.

A fourth pair of conductors **56*y* extend from harness 34 along opposite sides 16 and 18 of housing 12, one conductor being electrically connected to a connector 58 (electrically connected to lamp holder 26) and one conductor being connected to electrical connector 60 (electrically connected to lamp holder 32). A pair of jumper wires 62 electrically connect connectors 58 and 60**.

The arrangement of the wiring of ballast 36 to the various lamp holders 24, 26, 30 and 32 is conventional in the art. However, one of the novel features of the present invention is the use of electrical conductors **48*b*, 52*r* and 56*y* which are mounted directly to housing 12 between the various electrical components. These conductors may be ribbon cable, flex circuits or the like, to simply and quickly interconnect the harness 34 (and ballast 36) with the lamp holders. Not only is the wiring simplified, but the labor in making the connections is also simplified and the time spent in installation is reduced. The electrical conductors may also be molded-in metal elements or plated-on conductor elements, to completely eliminate the need for manual labor in making the electrical interconnections. In addition, housing 12** may be molded with the lamp holders and electrical connectors integral therewith, thereby reducing further assembly steps. This makes complete automation of the assembly of the fixture a realistic possibility.

By use of a wiring harness and ballast with a wiring harness connector, the laborious task of trimming and connecting leads from the ballast to electrical components is eliminated. This greatly reduces the amount of time and labor necessary to manufacture the fixture 10. The use of leadless ballast 36 allows quick and easy connection to wiring harness 34 via end connector 44. Ballast 36 may be affixed in position by screws, riveting or in any other conventional manner. In the first embodiment of FIGS. 1 and 2, one end is held in position by harness 34, which is mounted to housing 12, thereby eliminating yet another step in manufacturing the fixture 10.

Figure 3:
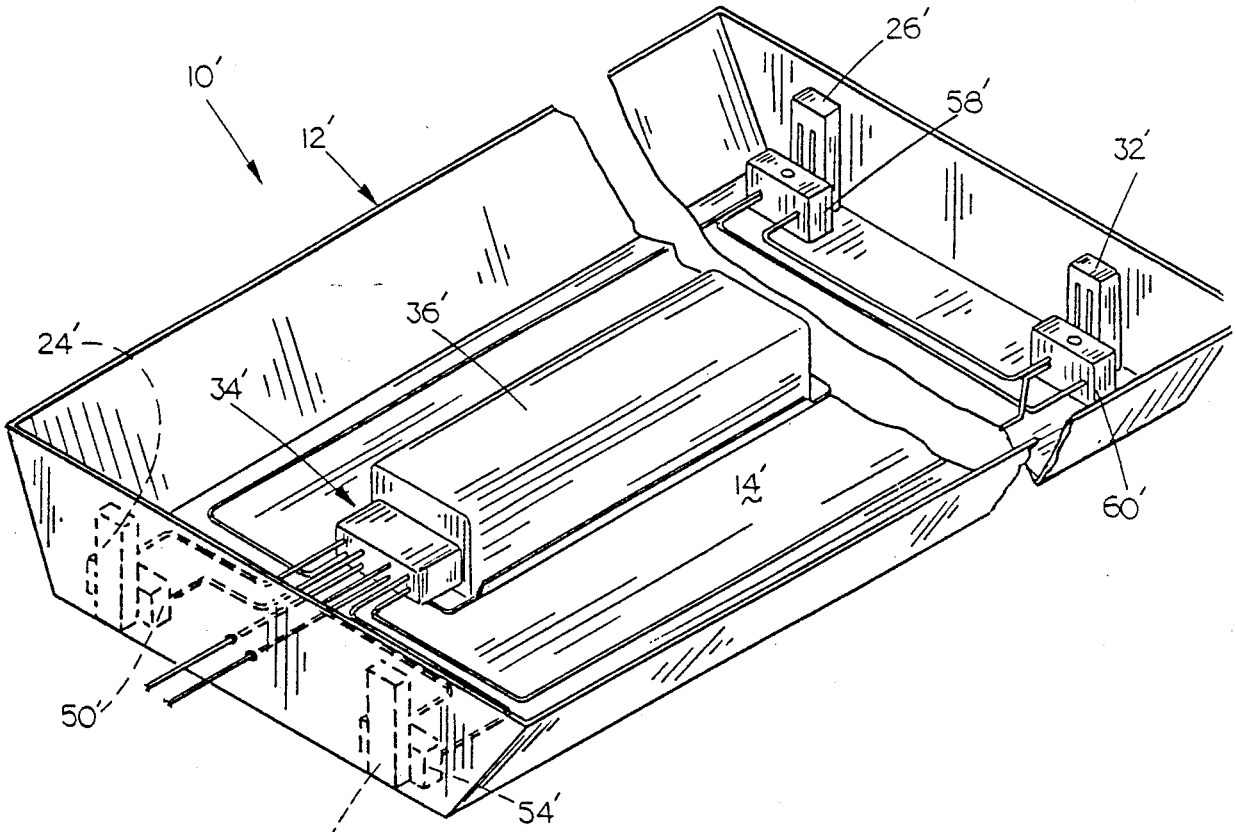
FIG. 3 is a perspective view of a second embodiment of the present invention, with portions cut away for clarity.
Figure 4:
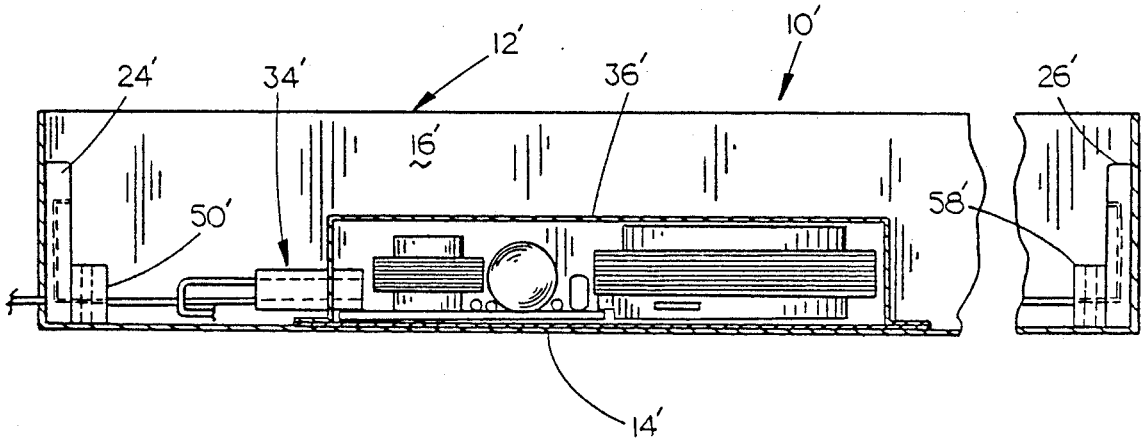
FIG. 4 is a longitudinal sectional view of the embodiment of FIG. 3.

Referring now to FIGS. 3 and 4, a second embodiment of the light fixture of the present invention is designated generally at 10', and is essentially identical to light fixture 10 except that wiring harness 34', is not mounted to housing 12'. In FIGS. 3 and 4, the designation "'" will be used to indicate identical structure to that previous described. Housing 12' would include a removable and replaceable ballast 36' mounted to base 14', as well as four lamp holders 24', 26', 30' and 32' mounted on housing 12'. The embodiment of FIGS. 3 and 4 permits the ballast 36' to be fitted with the wiring harness 34' and arranged on housing 12' in a variety of locations, depending upon the particular light fixture with which the ballast will be used. Thus, a single ballast component may be utilized with different types of light fixtures which require placement of the ballast in different locations. As with the first embodiment 10', all of the electrical conductors are flex circuits, ribbon cable or the like, mounted directly to housing 12' so as to eliminate discrete conductors.

Figure 5:
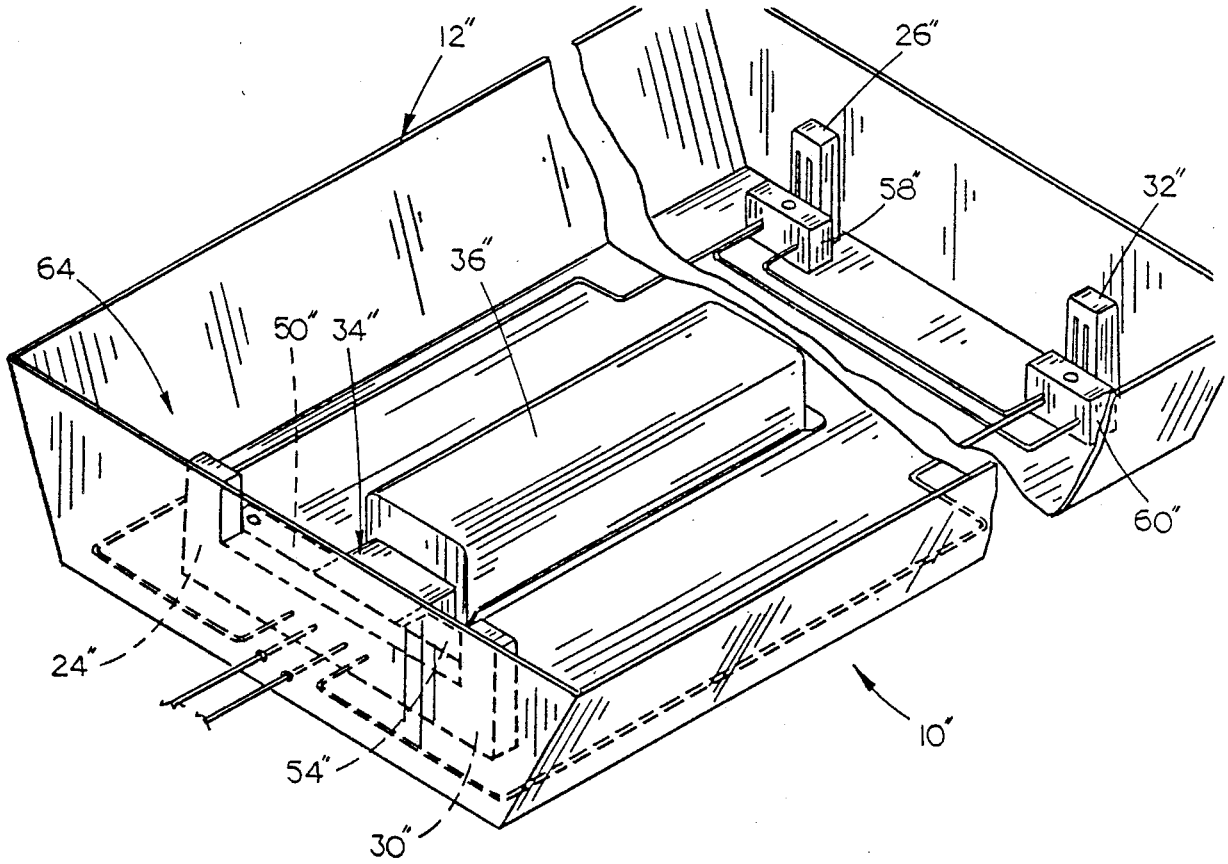
FIG. 5 is a perspective view of a third embodiment of the present invention, with portions cut away for clarity.
Figure 6:
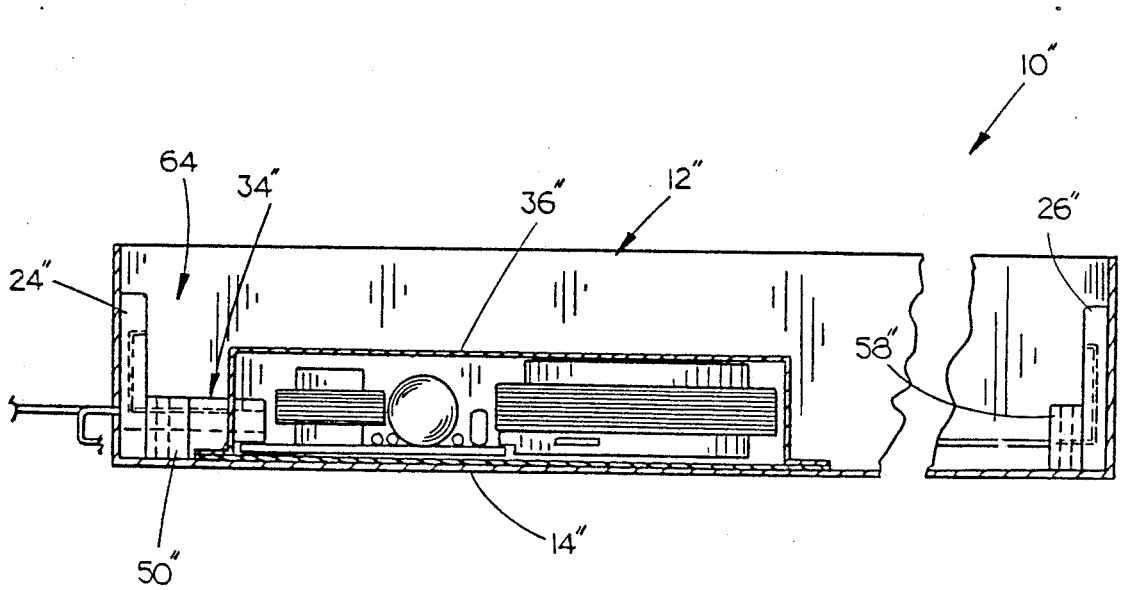
FIG. 6 is a sectional view of the embodiment of FIG. 5.

Referring now to FIGS. 5 and 6, a third embodiment of the present invention is designated generally at 10'' and includes a housing 12'' and ballast 36'', the same as the embodiments of 10 and 10'. In FIGS. 5 and 6, the designation "'" will be employed to indicate identical structure to that previously described. The main difference in the embodiment of 10'', is in the use of a wiring harness and lamp holder subassembly, designated generally at 64, which is formed integrally and mounted on housing 12''. Subassembly 64 includes lamp holder portions 24'' and 30'' in combination with connector portions 50'' and 54'' all in combination with wiring harness component 34''. Subassembly 64 integrates all of these components, and the electrical connections therebetween, into a single unitized assembly which may then be mounted on casing 12''. This embodiment also eliminates all discrete conductors between the ballast and two of the lamp holders. To achieve a totally "leadless" fixture, the two discrete conductors **56*y* could be replaced by a simple flex circuit connected between the wiring harness portion 34'' and then routed through a very small channel in housing 12'' to lamp holders 26'' and 32''**.

Whereas the invention has been shown and described in connection with the preferred embodiments thereof, it will be understood that many modifications, substitutions and additions may be made which are within the intended broad scope of the appended claims. For example, the fixture 10 could be manufactured for use with only a single lamp, or for a larger number of lamps. Similarly, housing 12 could consist of a single or a multiple piece construction, depending upon the manufacturer's requirements and ease of assembly. In any case, the various alternatives would offer the fixture manufacturer the ability to select the amount of reduction of discrete conductor leads appropriate to his type of assembly equipment and fixture designs.

It can therefore be seen that the present invention fulfills at least all of the above stated objects.

I claim:

1. A lamp fixture for holding at least one elongated lamp, comprising:

a housing including a substantially flat rectangular base portion having opposite ends, opposite sides, and top and bottom surfaces, a pair of end walls extending downwardly from the opposite ends of said base portion, and a pair of side walls extending downwardly from the opposite ends of said base portion, a first lamp holder means mounted adjacent one end of said base portion at the bottom surface thereof for receiving one end of the lamp therein;

a second lamp holder means mounted adjacent the other end of said base portion at the bottom surface thereof for receiving the other end of the lamp therein;

a first electrical conductor means mounted on said housing and having one end thereof electrically connected to said first lamp holder means for providing electrical power to one end of the lamp;

a second electrical conductor means mounted on said housing and having one end thereof electrically connected to said second lamp holder means for providing electrical power to the other end of the lamp;

a lamp ballast positioned on the bottom surface of said base portion between said end walls and said side walls;

a ballast wiring harness means mounted on the bottom surface of said base portion and adapted to be electrically connected to said lamp ballast;

the other ends of said first and second electrical conductor means being electrically connected to said ballast wiring harness means;

said lamp ballast being removably mounted on said bottom surface of said base portion so that said lamp ballast may be removed from directly beneath the lamp fixture.

2. The lamp fixture of claim 1 wherein said lamp ballast has all of its electrical connections at one end thereof.

3. The lamp fixture of claim 1 wherein said wiring harness means is affixed to the bottom surface of said base portion.

* * * * *